US007536933B1

(12) United States Patent
Torres, Jr.

(10) Patent No.: US 7,536,933 B1
(45) Date of Patent: May 26, 2009

(54) PLANK SEATING APPARATUS

(76) Inventor: Carlos M. B. Torres, Jr., 369604 N. Rolling Green Way, Anthem, AZ (US) 85086

( * ) Notice: Subject to any disclaimer, the term of this patent is extended or adjusted under 35 U.S.C. 154(b) by 0 days.

(21) Appl. No.: 11/738,764

(22) Filed: Apr. 23, 2007

(51) Int. Cl.
*E04F 15/00* (2006.01)
*B66F 3/00* (2006.01)

(52) U.S. Cl. ..... 81/46; 254/11

(58) Field of Classification Search ..... 81/46; 254/1, 11, 16; 29/254, 275, 276, 281.6, 525; 52/539

See application file for complete search history.

(56) References Cited

U.S. PATENT DOCUMENTS 1,159,963 A * 11/1915 Landgraf ..... 81/46
1,161,207 A 11/1915 Hagel
4,683,631 A 8/1987 Dobbertin
D353,987 S 1/1995 Pasto
5,435,610 A 7/1995 Roberts
5,819,393 A 10/1998 Bockart et al.
5,845,548 A 12/1998 Nelson
5,984,271 A 11/1999 Ellenberger
2005/0252167 A1 11/2005 Van Horne, Jr.
2006/0278046 A1 * 12/2006 Gargano ..... 81/46
2007/0022845 A1 * 2/2007 Lee-Rodrigues et al. ..... 81/46

* cited by examiner

*Primary Examiner*—David B Thomas

(57) ABSTRACT

A plank seating apparatus includes an elongated panel that has a top side, a bottom side, a first end, a second end, a first lateral edge and a second lateral edge. A bracket is attached to the bottom side and extends downwardly therefrom. The bracket includes a plate that has an outer surface that is flush with the first end. The outer surface faces away from the second end of the elongated panel. A block is attached to the top side of the panel. The block is positioned nearer to the second end than the first end of the panel. The plate is abutted against an outer edge of a wood plank and the block is hit with a tool to pull the wood plank toward an adjacent wood plank.

7 Claims, 4 Drawing Sheets

PLANK SEATING APPARATUS

BACKGROUND OF THE INVENTION

1. Field of the Invention

The present invention relates to plank seating devices and more particularly pertains to a new plank seating device for seating the final plank of a floor which is positioned adjacent to a wall without risking damage to the wall.

2. Description of the Prior Art

The use of plank seating devices is known in the prior art. While these devices fulfill their respective, particular objectives and requirements, the need remains for a device that can be effectively used to pull a plank of wood into seated arrangement with an adjacent plank when the plank being seated is adjacent to a wall. Typically, tools are used to pry the plank away from the wall and into the seated position. However, this process can damage the wall. The device may be used to without having to engage the wall and thereby without risk of damaging the wall.

SUMMARY OF THE INVENTION

The present invention meets the needs presented above by generally comprising an elongated panel that has a top side, a bottom side, a first end, a second end, a first lateral edge and a second lateral edge. A bracket is attached to the bottom side and extends downwardly therefrom. The bracket includes a plate that has an outer surface that is flush with the first end. The outer surface faces away from the second end of the elongated panel. A block is attached to the top side of the panel. The block is positioned nearer to the second end than the first end of the panel. The plate is abutted against an outer edge of a wood plank and the block is hit with a tool to pull the wood plank toward an adjacent wood plank.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
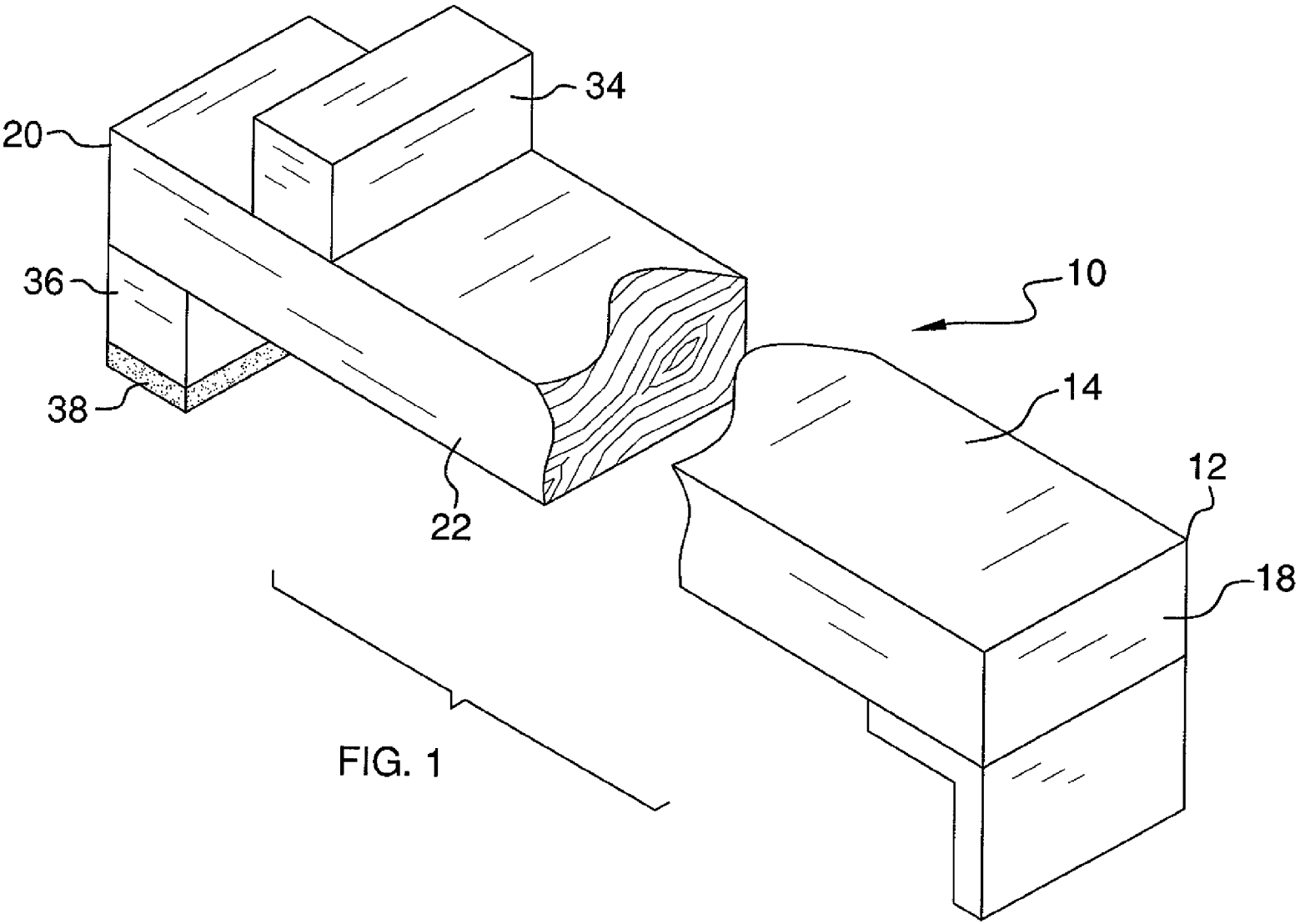
FIG. 1 is a broken top perspective view of a plank seating apparatus according to the present invention.
Figure 2:
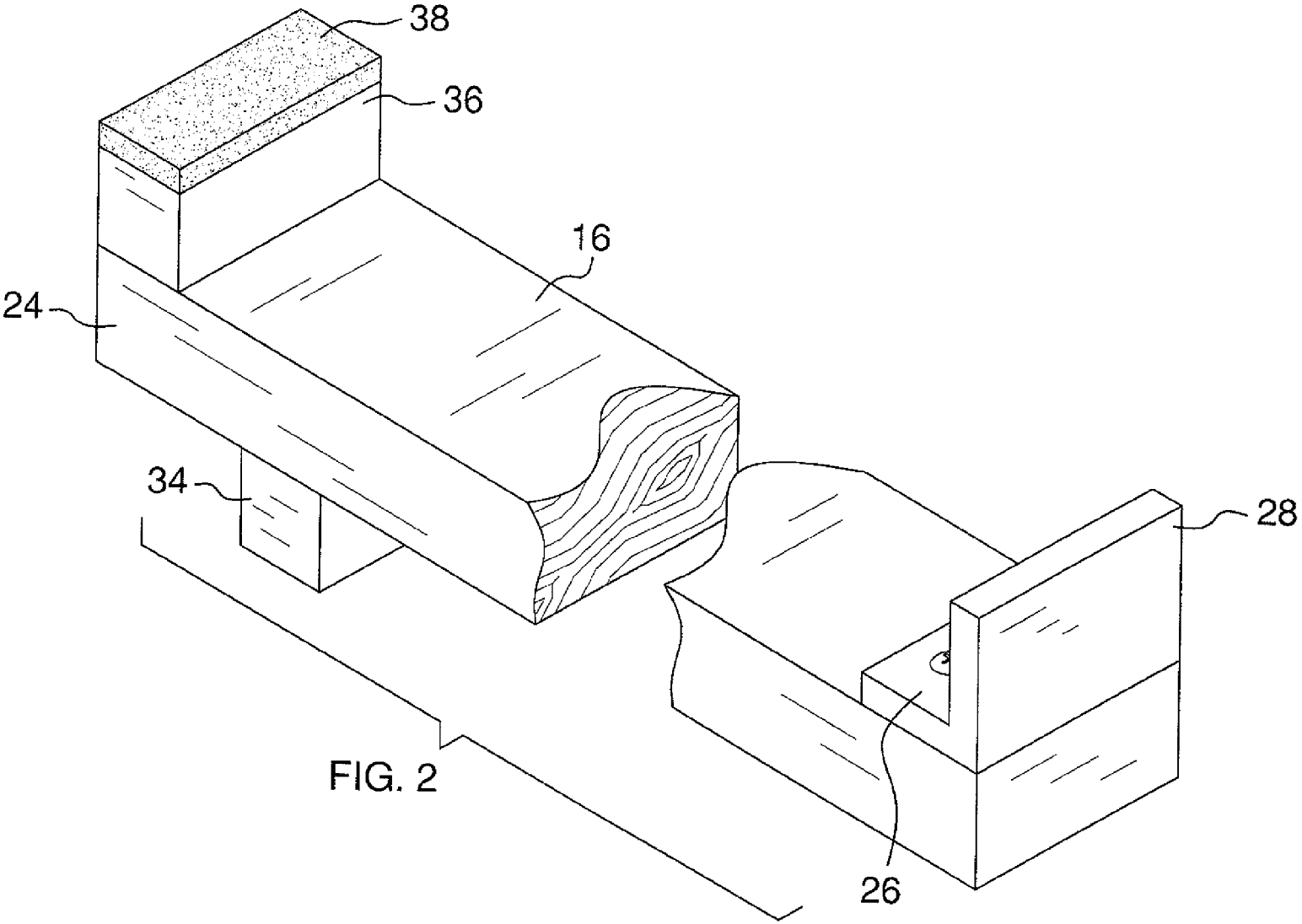
FIG. 2 is a broken bottom perspective view of the present invention.
Figure 3:
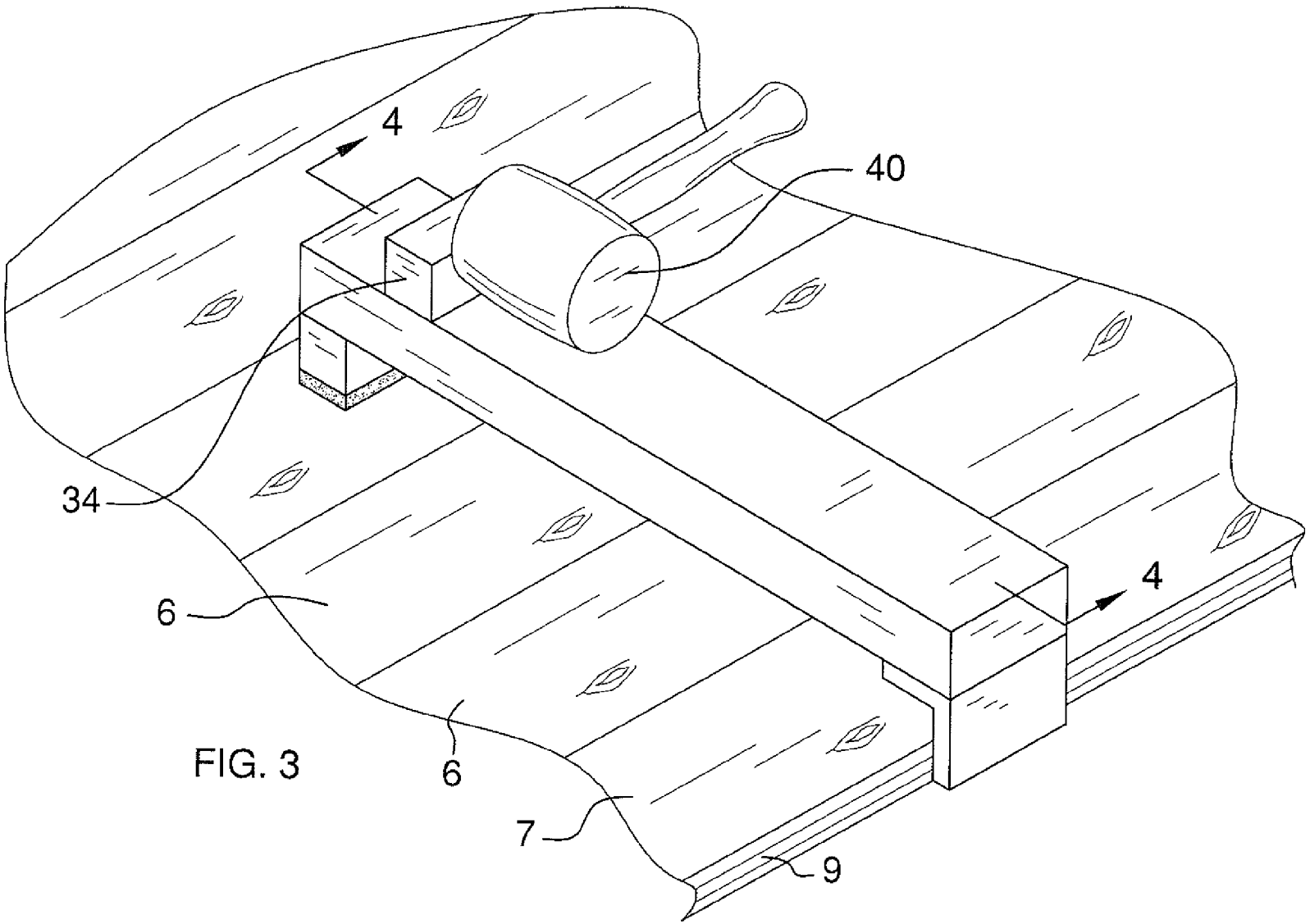
FIG. 3 is a perspective in-use view of the present invention.
Figure 4:
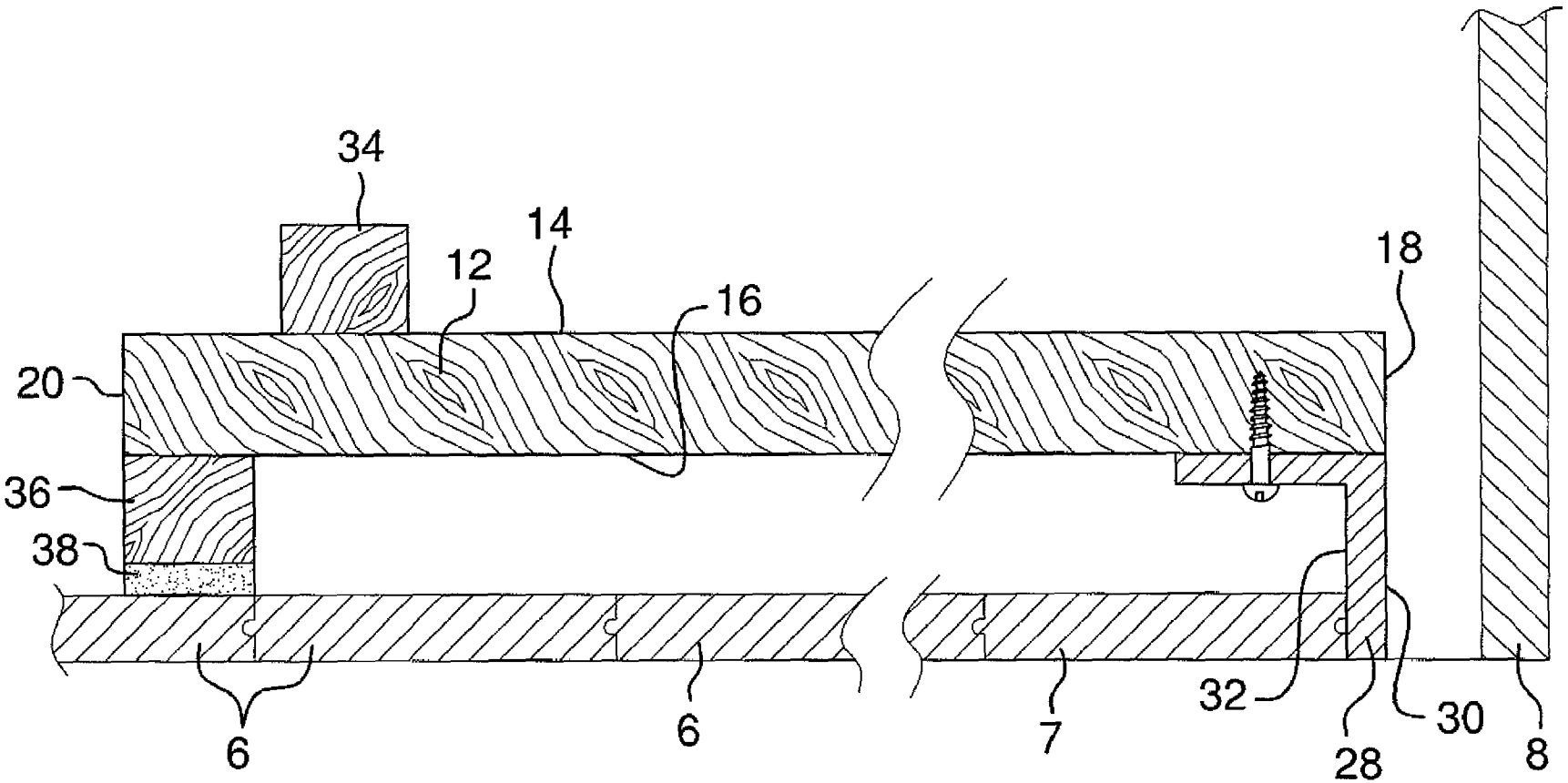
FIG. 4 is a cross-sectional view taken along line 4-4 of FIG. 3 of the present invention.

With reference now to the drawings, and in particular to FIGS. 1 through 4 thereof, a new plank seating device embodying the principles and concepts of the present invention and generally designated by the reference numeral 10 will be described.

As best illustrated in FIGS. 1 through 4, the plank seating apparatus 10 generally comprises an elongated panel 12 that has a top side 14, a bottom side 16, a first end 18, a second end 20, a first lateral edge 22 and a second lateral edge 24. The panel 12 has length equal to about 24 inches and a width equal to between 3 inches and 5 inches.

A bracket 26 is attached to the bottom side 16 and extends downwardly therefrom. The bracket 26 includes a plate 28 that has an outer surface 30 that is flush with the first end 18. The outer surface 30 faces away from the second end 20 of the elongated panel 12. The plate 28 has a width from the outer surface 30 to an inner surface 32 that is less than one inch. The bracket 26 is made of a metallic material.

A block 34 is attached to the top side 14 of the panel 12. The block 34 is positioned nearer to the second end 20 than the first end 18 of the panel 12. The block 34 extends between 2 and 4 inches upwardly from the panel 12.

A leg 36 is attached to the bottom side 16 and extends downwardly therefrom. The leg 36 is positioned adjacent to the second end 20 of the panel 12. The leg 36 has a height dimension that is less than a height dimension of the plate 28. The height dimension of the plate 28 is between ½ inch and 1½ inches greater than the height dimension of the leg 36. A cushioning material 38 is attached to a distal end of the leg 36 with respect to the panel 12. The cushioning material 38 comprises a cloth material such as felt and prevents the marring of wood panels 6.

In use, a plurality of wood planks 6, which are of the tongue and groove type planks, are attached together. When the last plank 7 is seated adjacent to a wall 8, the plate 28 is abutted against its outer edge 9 and the block is hit with a tool 40, such as a mallet, to pull the wood plank 7 toward an adjacent wood plank 8. This prevents the need of using a tool to pry the final plank 7 away from the wall 8 which can cause damage to the wall 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wood plank seating assembly for forcing together tongue and groove wood planks, said assembly comprising:

an elongated panel having a top side, a bottom side, a first end, a second end, a first lateral edge and a second lateral edge;

a bracket being attached to said bottom side and extending downwardly therefrom, said bracket including a plate having an outer surface being flush with said first end, said outer surface facing away from said second end of said elongated panel;

a block being attached to said top side of said panel, said block being positioned nearer to said second end than said first end of said panel;

wherein said plate is abutted against an outer edge of a wood plank and said block hit with a tool to pull the wood plank toward an adjacent wood plank; and a leg being attached to said bottom side and extending downwardly therefrom, said leg being positioned adjacent to said second end of said panel.

2. The assembly according to claim 1, wherein said plate has a width from said outer surface to an inner surface being less than one inch.

3. The assembly according to claim 1, wherein said leg has a height dimension being less than a height dimension of said plate.

4. The assembly according to claim 3, wherein said height dimension of said plate is between ½ and 1½ inches greater than said height dimension of said leg.

5. The assembly according to claim 1, further including a cushioning material being attached to a distal end of said leg with respect to said panel.

6. The assembly according to claim 5, wherein said cushioning material comprises a cloth material.

7. A wood plank seating assembly for forcing together tongue and groove wood planks, said assembly comprising:

an elongated panel having a top side, a bottom side, a first end, a second end, a first lateral edge and a second lateral edge;

a bracket being attached to said bottom side and extending downwardly therefrom, said bracket including a plate having an outer surface being flush with said first end, said outer surface facing away from said second end of said elongated panel, said plate having a width from said outer surface to an inner surface being less than one inch;

a block being attached to said top side of said panel, said block being positioned nearer to said second end than said first end of said panel;

a leg being attached to said bottom side and extending downwardly therefrom, said leg being positioned adjacent to said second end of said panel, said leg having a height dimension being less than a height dimension of said plate, said height dimension of said plate being between ½ inch and 1½ inches greater than said height dimension of said leg;

a cushioning material being attached to a distal end of said leg with respect to said panel, said cushioning material comprising a cloth material; and wherein said plate is abutted against an outer edge of a wood plank and said block hit with a tool to pull the wood plank toward an adjacent wood plank.

* * * * *